US005664343A

United States Patent [19]

Byrne

[11] Patent Number: 5,664,343

[45] Date of Patent: Sep. 9, 1997

[54] SHOE HAVING A WATERPROOF LINER

[75] Inventor: Richard Byrne, Marlboro, Mass.

[73] Assignee: The Rockport Company, Inc., Marlboro, Mass.

[21] Appl. No.: 445,033

[22] Filed: May 19, 1995

[51] Int. Cl.[6] ..... A43B 23/07; A43B 13/28; A43B 1/02

[52] U.S. Cl. ..... 36/55; 36/12; 36/9 R

[58] Field of Search ..... 36/54, 55, 10, 36/12, 14, 16, 9 R, 46.5, 45

[56] References Cited

U.S. PATENT DOCUMENTS

| | | | |
|---|---|---|---|
| Re. 34,890 | 4/1995 | Sacre | 36/55 |
| 2,619,741 | 12/1952 | Clark . | |
| 3,350,795 | 11/1967 | Schlecht . | |
| 4,292,746 | 10/1981 | Delaney | 36/83 |
| 4,550,446 | 11/1985 | Herman | 2/239 |
| 4,559,810 | 12/1985 | Sacre | 36/55 |
| 4,704,808 | 11/1987 | Bianchini et al. | 36/102 |
| 4,706,316 | 11/1987 | Tanzi | 36/55 X |
| 4,736,531 | 4/1988 | Richard | 36/55 X |
| 4,852,275 | 8/1989 | Bianchini et al. | 36/102 |
| 5,285,546 | 2/1994 | Haimerl | 12/142 E |
| 5,337,493 | 8/1994 | Hill | 36/55 X |
| 5,426,869 | 6/1995 | Gore et al. | 36/22 R |
| 5,499,459 | 3/1996 | Tomaro | 36/55 X |
| 5,526,584 | 6/1996 | Bleimhofer et al. | 36/55 X |

FOREIGN PATENT DOCUMENTS

| | | | |
|---|---|---|---|
| 690392 | 9/1930 | France . | |
| 1850326 | 4/1962 | Germany . | |
| 3628913 | 3/1988 | Germany | 36/55 |

OTHER PUBLICATIONS

Schachter, R., *Dictionary of Shoe Industry Terminology*, 1986.

*Primary Examiner*—B. Dayoan

*Attorney, Agent, or Firm*—Sterne, Kessler, Goldstein & Fox P.L.L.C.

[57] ABSTRACT

A shoe construction is provided which is waterproof and breathable. The construction includes a liner which is impervious to water, yet pervious to water vapor. The liner covers the entire top of the foot of the wearer but is open under the forefoot area of the foot. The shoe is lasted using a combination of techniques. The forepart of the shoe is cement lasted while the rearpart of the shoe is of a stitched construction.

7 Claims, 4 Drawing Sheets

SHOE HAVING A WATERPROOF LINER

BACKGROUND OF THE INVENTION

1. Field of the Invention

The present invention relates to a waterproof shoe construction and more particularly, to a waterproof liner for a shoe.

2. Related Art

Most shoe uppers are manufactured of leather or textile material. If the material is not specially treated, it will easily allow water to penetrate it. Such penetration causes the shoe upper to become wet, which in turn can cause the wearer's sock and eventually the wearer's foot to become wet. Walking in a wet shoe is not only uncomfortable, it can cause foot ailments such as blisters to occur.

To remedy this, it is common to apply a waterproof material such as oil, wax, latex, rubber and/or other waterproofing substance to the interior or exterior of the shoe upper. It is also common to manufacture waterproof shoes from rubber or plastic. While these materials do cause the shoe to be waterproof, they do not allow the wearer's foot inside the shoe to breathe. As a result, the foot may perspire causing the foot, the wearer's sock, and eventually even the shoe upper to become wet. As noted above, walking in a wet shoe is quite uncomfortable and unhealthy.

Recent attempts have been made to manufacture shoes which incorporate a liner made of a material which is impervious to water, yet pervious to water vapor. One example is found in U.S. Pat. No. 4,599,810 to Sacre, which is now U.S. Pat. No. Re. 34,890. This patent discloses the use of a sock-like inner lining made of GORE-TEX® material a composite including a layer of polytetrafluoroethylene (PTFE) manufactured by W. L. Gore & Associates, Newark, Del. This material which is inserted into the shoe upper during the manufacturing process. The lining is secured to the upper by stitching along the top or ankle opening of the shoe. The lining is otherwise unattached to the shoe upper.

The lining disclosed in the Sacre patent does generally eliminate the problems noted above. However, because the lining is sock-like and forms a complete enclosure around the wearer's foot, the lining uses more waterproof material than is necessary to waterproof the shoe. As GORE-TEX® material is expensive, the resultant cost to manufacture a shoe incorporating the Sacre technology is quite high.

Therefore, the need exists for a comfortable, waterproof shoe construction which is easy and less expensive to manufacture than existing shoe constructions.

SUMMARY OF THE INVENTION

It is an object of the present invention to provide a comfortable, waterproof shoe construction which is easy and economical to manufacture. It is another object of the invention to provide a waterproof shoe construction that is durable, yet, allows the wearer's foot to breathe. It is a further object of the present invention to provide a waterproof shoe liner which can be incorporated into a shoe having a construction which is rigid in the back and flexible in the front of the shoe.

In accordance with the invention, a shoe that has a sole and an upper attached to the sole includes a liner disposed within the upper. The liner includes a main body section forming a complete enclosure for the heel and sides of the foot of a wearer. The main body section forms a sole section which lies under the arch and heel area of a wearer's foot.

A toe section of the liner is attached to the main body section forming an enclosure for the top of the toes and the forefoot of a wearer's foot. An opening, which is defined by the main body section and the toe section is underneath the toes and forefoot of a wearer's foot. In one embodiment, the upper has a forepart which is cement lasted together with the toe section of the liner to the sole. The upper has a rearpart which is lasted to the sole by stitching. The liner may be formed of a material that is impervious to water but pervious to perspiration vapor. The shoe may also include an insole that is waterproof.

With the present invention, it is possible and advantageous to secure the forepart of the liner together with the forepart of the upper to integrate the liner into the construction of the shoe. This feature allows the liner to be secured to the shoe without sacrificing waterproofness. At the same time, the mount of waterproof material used is reduced because the waterproof material at the forepart of the sole of the liner is eliminated.

BRIEF DESCRIPTION OF THE DRAWINGS

The accompanying drawings, which are incorporated in and form a part of the specification, illustrate different embodiments of the present invention and, together with the description, serve to explain the principles of the invention. In the drawings.

DETAILED DESCRIPTION OF THE PREFERRED EMBODIMENTS

Figure 1:
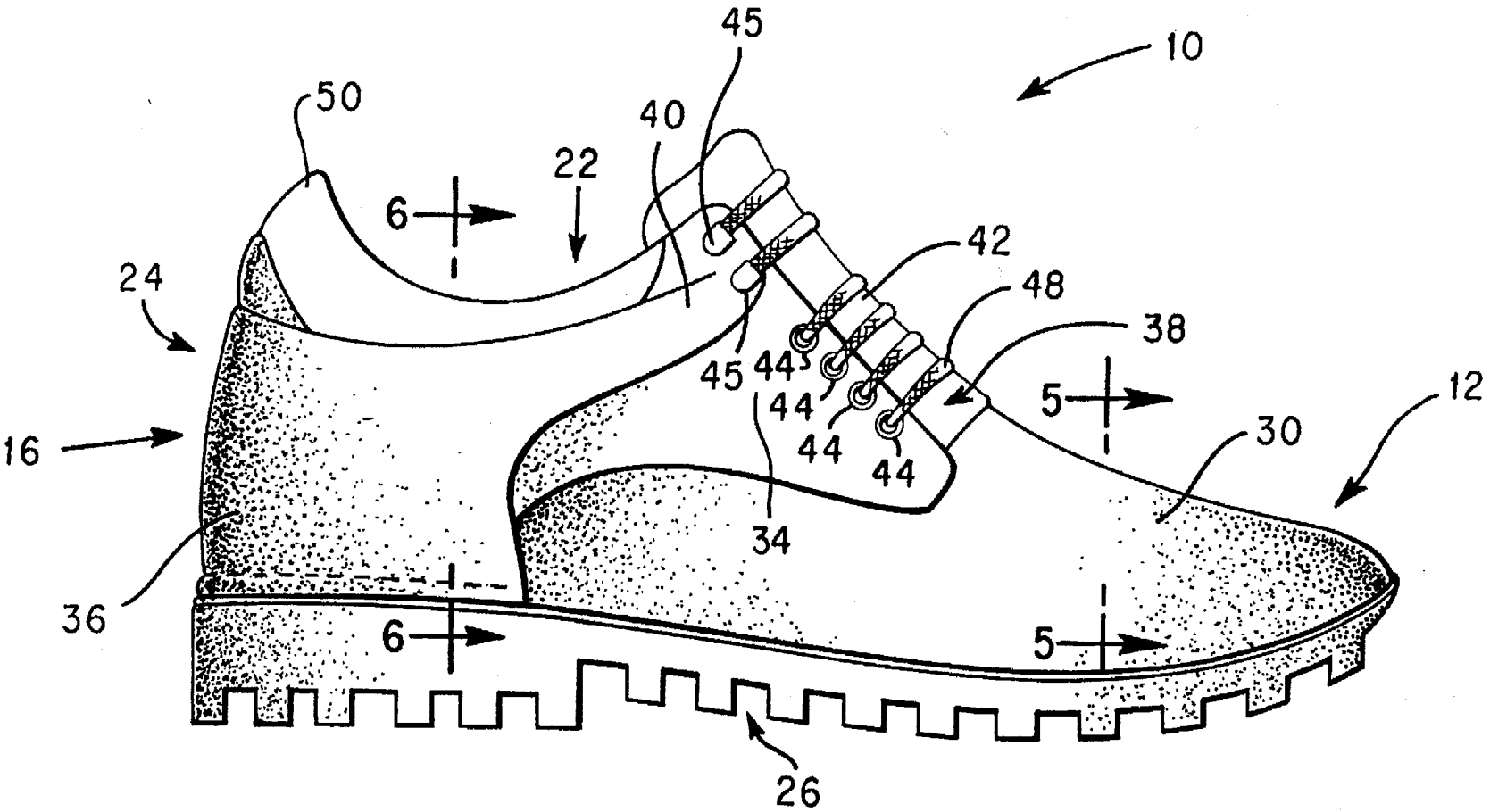
FIG. 1 is a side view of a shoe incorporating the present invention.

With reference to the Figures in which similar reference numbers have been used to indicate similar elements, a shoe is shown generally at 10. While a shoe for the right foot is shown in the figures, it should be understood that a shoe for the left foot would be a mirror image thereof. Shoe 10 includes a forepart shown generally at 12 and a rearpart shown generally at 16. Shoe 10 consists generally of an upper 24 attached to sole 26. Upper 24 is lasted to sole 26 in a manner disclosed in U.S. Pat. Nos. 4,704,808 and 4,852,275, both,to Bianchini et al. The disclosure of both patents is hereby incorporated by reference in their entirety. For example, forepart 12 of upper 24 may be cement lasted to an insole board, (shown later) and then attached by cement to sole 26, while rearpart 16 of Upper 24 is stitched down to the insole board using a san crispino construction and then attached by cement to sole 26, as will be discussed in greater detail below. This dual construction provides a shoe which is flexible in the forepart of the shoe, but is rigid in the back part. This gives the wearer the advantages of a shoe which is easily bendable at the ball of the foot, yet stable in the heel area.

Upper 24 is preferably made of leather, but may also be made of textile or synthetic material or a combination of leather, textile and synthetic materials. Upper 24 includes a vamp 30 attached by stitching to a quarter panel 34 on each side of shoe 10. A heel foxing 36 is attached by stitching to a quarter panel 34 on each side of shoe 10. Vamp 30 and quarter panels 34 are provided with a lace opening 38. Four eyelets 44 and two speed loops 45 for receiving a shoe lace 48 are provided along each side of lace opening 38. A conventional tongue and gusset 42 is formed at lace opening 38. The folds (not shown) of tongue and gusset 42 expand and contract for insertion and removal of the wearer's foot. Heel foxing 36 includes a forwardly extending strap 40. One of the two speed loops is attached to strap 40. Although one type of lacing system is disclosed, it is within the scope of the invention to use other types of lacing systems. A top opening 22 is defined by quarter panels 34 and tongue and gusset 42. A padded collar 50 is provided about the upper edge of top opening 22 to provide additional comfort to the wearer. Sole 26 is made of rubber or other type of conventional material used to manufacture shoe soles.

Figure 2:
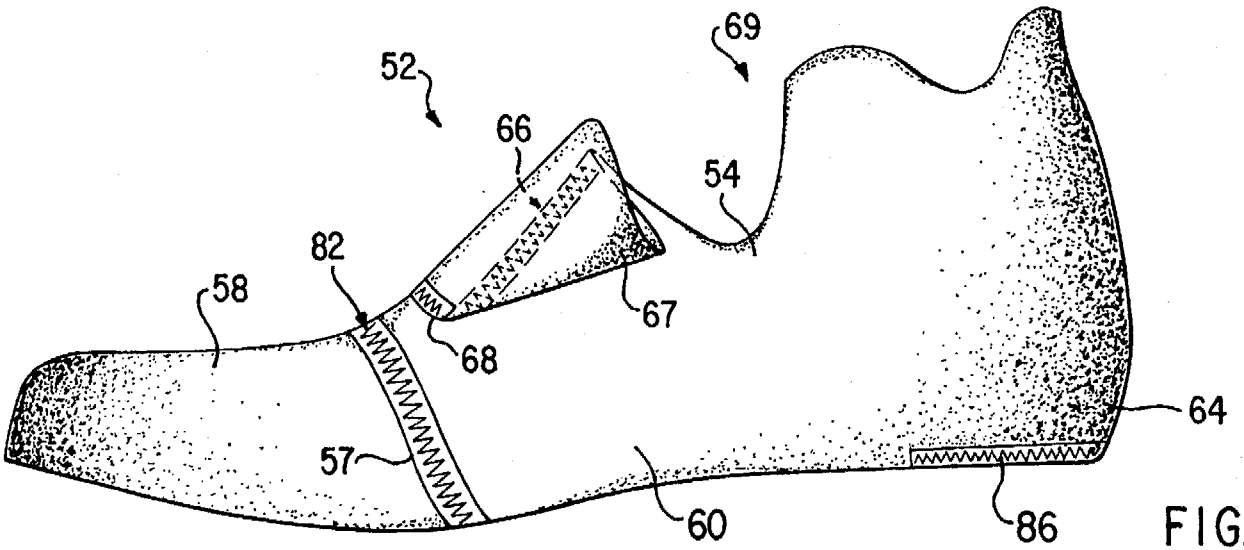
FIG. 2 is a side view of the waterproof liner of the present invention.

Shoe 10 is made waterproof by the inclusion of a liner shown generally at 52 in FIG. 2. Liner 52 is of a novel shape and construction so that it may be integrated into the construction of shoe 10 to make shoe 10 waterproof to the wearer's foot, yet allowing the wearer's foot to breathe. Liner 52 is preferably made in two sections, a main body section 54 and a toe'section 58. Main body section 54 includes an instep region 60 and a heel region 64. Main body section 54 also forms a sole section 72 (discussed below with reference to FIG. 3) which lies completely underneath the arch and heel areas of a wearer's foot. Main body section 54 forms a complete enclosure for the heel and sides of the foot of a wearer. A conventional tongue and gusset 66 comprising folded portions 67 is formed in instep region 60. As shown, tongue and gusset 66 is joined to main body section 54 by seam 68 (a portion of seam 68 is shown by broken lines). Seam 68 is formed by stitching tongue and gusset 66 to main body section 54 and then covering the stitched seam with waterproof seam tape as is known in the art. In the alternative, seam 68 may be coated with latex or other waterproof material. Tongue and gusset 66 also may be formed integral with main body section 54. Tongue and gusset 66 corresponds to tongue and gusset 42 of upper 24. Accordingly, tongue and gusset 66 of liner 52 also expand and contract to permit insertion and removal of the wearer's foot, as discussed above. An ankle opening 69 is formed at the top of main body section 54, adjacent tongue and gusset 66 and corresponding to top opening 22 in shoe 10. The foot of a wearer is inserted into liner 52 through ankle opening 69.

Figure 3:
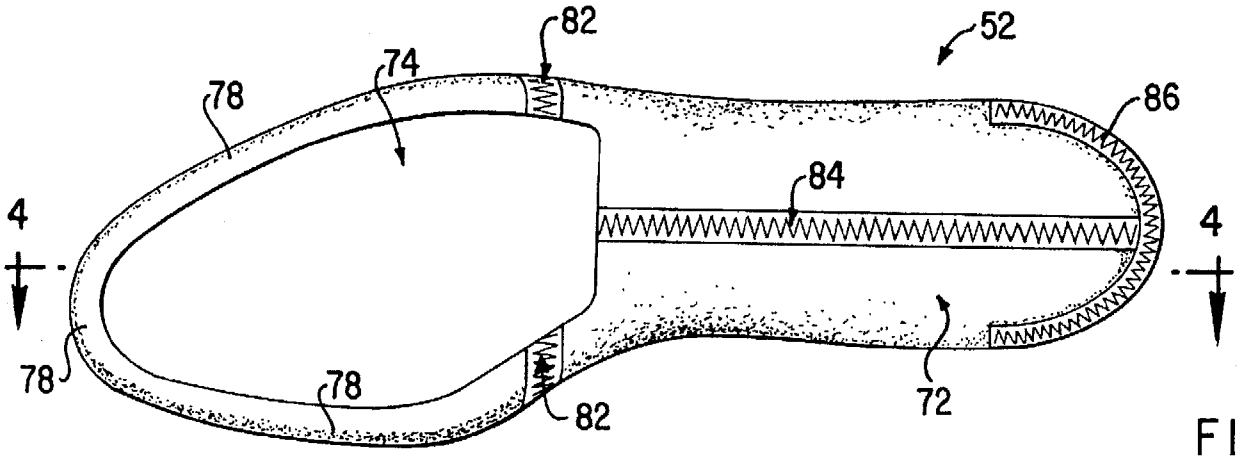
FIG. 3 is a bottom view of the liner of FIG. 2.

Toe section 58 lies over the toes and forefoot of a wearer's foot such that toe section 58 forms an enclosure for the top of the toes and forefoot of a wearer's foot. Toe section 58 is joined to main body section 54 at instep region 60 by a central seam 82. Seam 82 is preferably formed by stitching toe section 58 to main body section 54. The stitched seam may then be covered by a waterproof material such as a seam tape 57, which is preferably waterproof. In the alternative, seam 82 may be coated with latex or other waterproof material. As best seen in FIG. 3, the lower edges of main body portion 54 opposite to ankle opening 69 are joined by a longitudinal stitched seam 84. The remaining opening in heel region 64 is closed by an arcuate stitched seam 86. Seams 84 and 86 cause main body portion 54 to form a sole section 72 of liner 52 that extends only under the arch and heel areas of a wearer's foot.

The lower edges of toe section 58 of liner 52 are turned under to form a lasting margin 78 along which liner 52 is lasted to the insole board. Lasting margin 78 of toe section 58, in combination with main body section 54, define an opening 74 Under the forefoot of a wearer in the bottom of liner 52. As a result, liner 52 extends under the heel of the foot of a wearer and the periphery of the forefoot, but it does not extend under the toes or complete forefoot area.

Liner 52 is made of a material which is impervious to water, yet pervious to water vapor. One example of a suitable material is PROTEIN-TEX available from Foot Techno Inc., Japan. Another example of a suitable material is GORE-TEX® available from W. L. Gore & Associates, Newark, Del. Both materials are a three layer composite comprised of a very thin sheeting or membrane of thermoplastic resin substance sandwiched between protective layers of abrasion resistant, porous material. As best seen in the cross sectional view of liner 52 in FIG. 4, one layer of abrasion resistant, porous material 75 is formed on interior surface of liner 52 and faces the foot of the wearer of shoe 10. The outer layer 71 is formed of abrasion resistant porous material and faces an inner surface of upper 24 and a portion of outer layer 71 faces sole 26. The very thin sheeting or membrane of thermoplastic resin substance 73 is sandwiched between layers 71 and 75.

Figure 4:
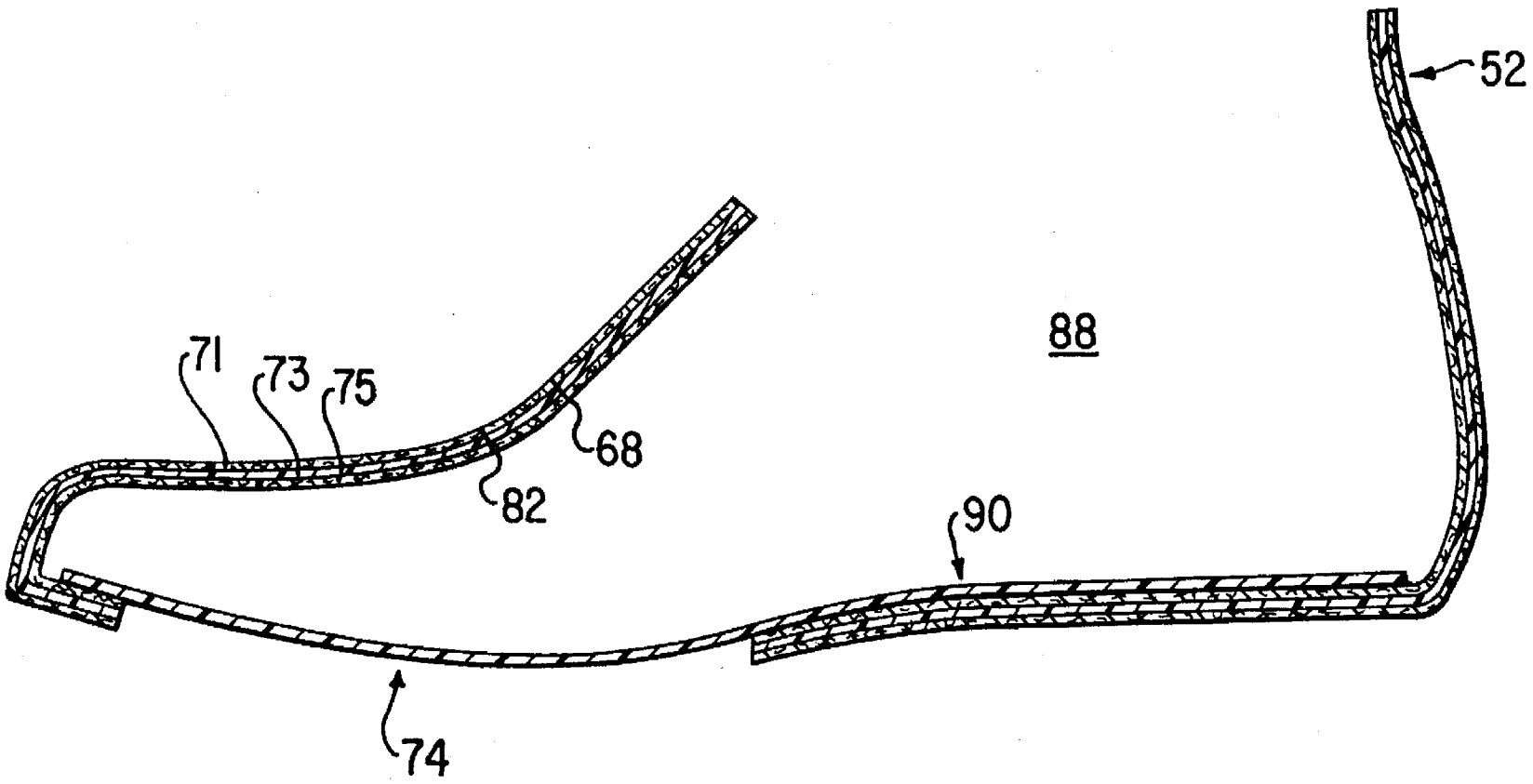
FIG. 4 is an expanded cross-sectional view taken along line 4—4 of FIG. 3.

As shown in FIG. 4, liner 52 forms an interior cavity 88 for receiving the foot of a wearer. A footbed 90 is disposed in interior cavity 88 covering opening 74 in liner 52. As will be discussed below with reference to FIG. 5, insole board 102 (not shown in FIG. 4) is interposed between footbed 90 and liner 52 in forepart 12 of upper 24. In rearpart 16 of upper 24, footbed 90 is disposed adjacent an interior cavity side of liner 52 such that liner 52 is sandwiched between footbed 90 and insole board 102 as will be discussed below with reference to FIG. 6. Footbed 90 is preferably made of a waterproof material such as a thermoplastic material. Footbed 90 may also be made of a waterproof, breathable material such as PROTEIN-TEX, however, it is not essential that it is. In use, footbed 90 is disposed between the bottom of the foot of the wearer and sole 26.

Figure 5:
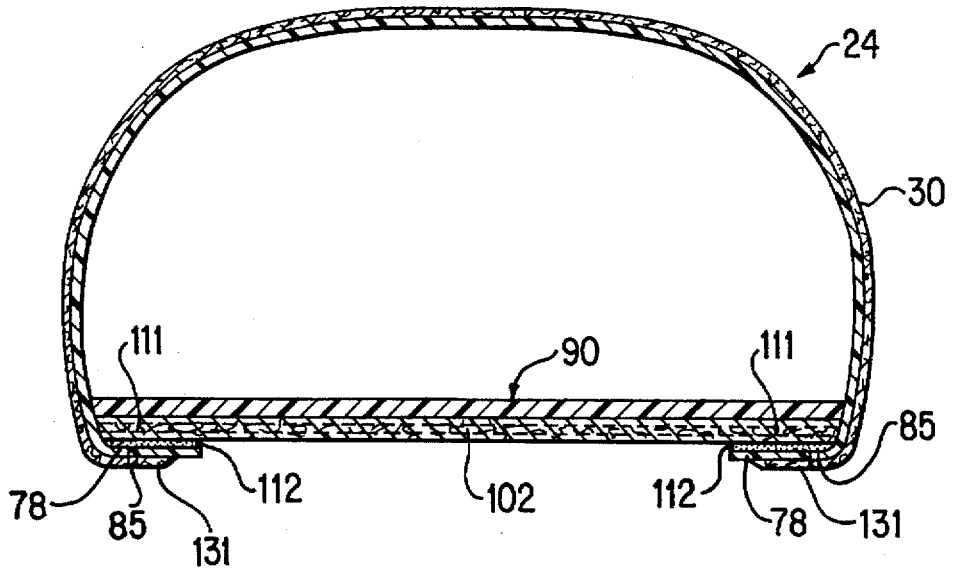
FIG. 5 is a cross-sectional view taken along line 5—5 in FIG. 1.
Figure 6:
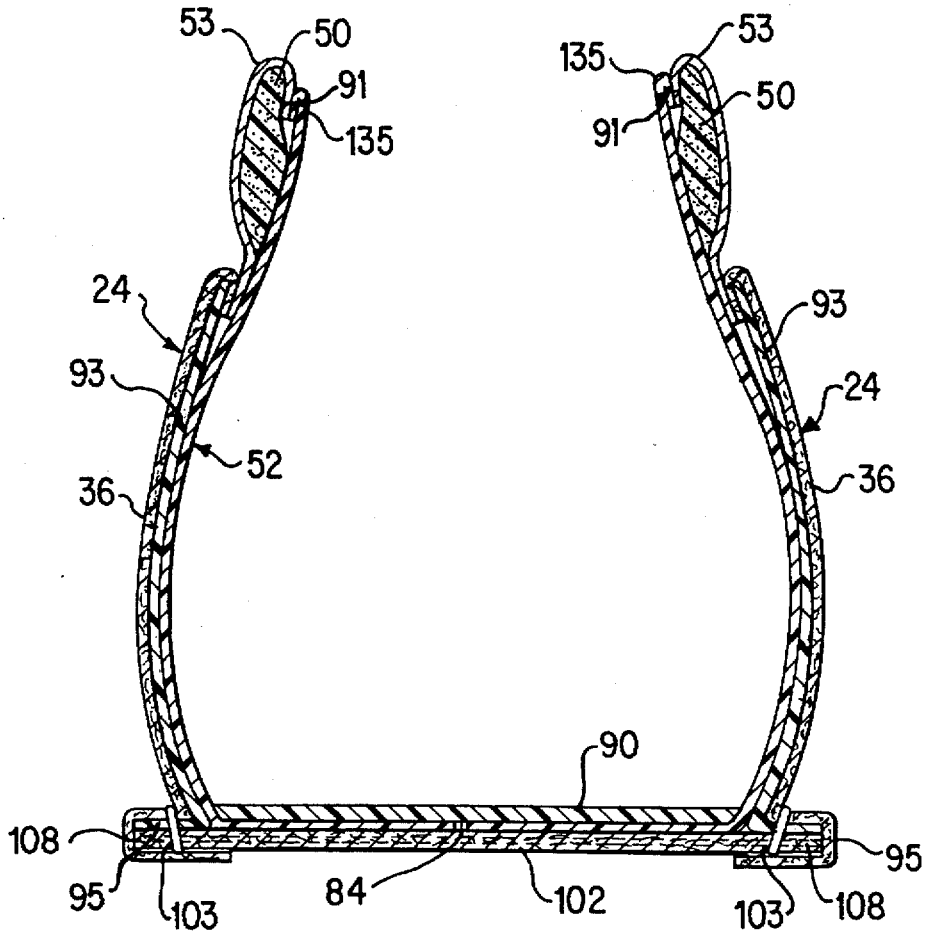
FIG. 6 is a cross-sectional view taken along line 6—6 in FIG. 1.

As best seen in FIGS. 5 and 6, liner 52 may be incorporated into shoe 10 in a manner similar to that disclosed in U.S. Pat. Nos. 4,704,808 and 4,852,275. An insole board 102 is provided for lasting upper 24 to sole 26. Upper 24 (and liner 52) are lasted to insole board 102 in two different ways-along the length of shoe 10

FIG. 5 illustrates how toe section 58 of liner 52 is disposed in forepart. 12 of upper 24 as well as the first way upper 24 (and liner 52) are lasted to insole board 102. In particular, lasting margin 78 of liner 52 is attached by stitching 85 to the interior suffice of lasting margin 131 of vamp 30 of upper 24. Then, lasting margin 131 of vamp 30 of upper 24 (and lasting margin 78 of liner 52) are cemented by cement 112 to an underside of lasting margin 111 of insole board 102. Waterproof cement is preferably used to adhere upper 24 (and liner 52) to the underside of lasting margin. 111 of insole board 102 to form a waterproof sealing engagement there between. By cement lasting the lasting margin 131 of vamp 30 of upper 24 in combination with lasting margin 78 of toe section 58 of liner 52, less liner material can be used because the liner material only has to comprise an amount sufficient to extend under lasting margin 111 of the forepart of insole board 102.

As best seen in FIG. 6, a cross section taken through rearpart 16 off shoe 10 illustrates how main body section 54 of liner 52 is disposed in rearpart 16 of upper 24 as well as the second way upper 24 is lasted 16 insole board 102. Liner 52 is incorporated into rearpart 16 of upper 24 of shoe 10 such that a top margin 135 at ankle opening 69 of liner 52 is attached to a margin 53 of top opening 22 of shoe upper 24 by stitching 91. Sole section 72 of liner 52 rests on an upper surface of insole board 102. In particular, sole section 72 of liner 52 is sandwiched between footed 90 and insole board 102. In construction, rearpart 16 of shoe 10 is lasted to sole 26 using a san crispino construction. A molded heel counter 93 having an outwardly turned flange 95 along its bottom periphery is positioned within a pocket formed in rearpart 16 of shoe 10 between heel foxing 36 of upper 24 and liner 52. Heel counter 93 is inserted between heel foxing 36 and liner 52 during the assembly of upper 24. Outwardly turned flange 95 of heel counter 93 plays a major role in imparting lateral stability to shoe 10 to reduce the danger of twisting the foot or ankle of the wearer. Heel counter 93 is also described in U.S. Pat. Nos. 4,704,808 and 4,852,275. The rearpart of insole board 102 has a wide outwardly extending lasting margin 108 corresponding to outwardly turned flange 95 on heel counter 93. In a san crispino construction as shown, the peripheral edge of upper 24 is wrapped around flange 95 of counter 93 and lasting margin 108 of insole board 102 and the four layers (peripheral edge of upper 24, flange 95, insole board 102, and peripheral edge of upper 24) are stitched together by stitches 103. An external portion of these stitches 103 is shown on rearpart 16 of shoe 10 in FIG. 1. By having sole section 72 of main body section 54 of liner 52 extend under the heel of a wearer's foot such that a complete enclosure for the heel and sides of the foot of a wearer is formed, it is possible to waterproof rearpart 16 of shoe 10, which is of san crispino construction. Sole 26 is then preferably attached to insole board 102 by cement or any other conventional techniques.

With the present invention, a more economical waterproof shoe has been discovered, which utilizes less lining material and a novel lining construction that can be utilized in numerous types of shoe constructions. In addition, since toe section 58 of liner 52 is partially integrated into the construction of shoe 10, liner 52 is secured into shoe 10 and it is less likely liner 52 will shift, fold or ripple under the foot of the wearer during use. Furthermore, since the forefoot of a wearer has a tendency to wear through an inside sole portion of a shoe in the forefoot region (wear which may cause leakage), a more durable type of material that is more resistant to wear may be used in opening 74 of liner 52.

As a result of this shoe and liner construction combination, a comfortable, waterproof shoe, is provided which has great forepart flexibility in a fore and aft direction while providing very substantial side to side stability so as to prevent roll over and twisting. In particular, effective width of shoe 10 at rearpart 16 (due to the wide lasting margin 108 of insole board 102 and flange 95 of counter 93) allows rearpart 16 of shoe 10 to further resist roll over as compared to conventionally cement lasted lightweight athletic shoes.

The preferred embodiment was chosen and described in order to best explain the principles of the present invention and its practical application to thereby enable others skilled in the art to best utilize the invention and various embodiments and with various modifications as are suited to the particular use contemplated. For example, as an alternative to the san crispino construction, a conventional stitched down construction may be used as a further alternative. It is intended that the scope of the invention be defined by the claims appended hereto.

What is claimed is:

1. A shoe comprising:

an insole board having a wide outwardly extending lasting margin extending about a portion of its periphery;

a sole;

an upper having an instep region and a forepart and rearpart lasted to said insole board;

a counter with an outwardly extending flange covered by said rearpart of said upper;

stitching joining said lasting margin of said insole board to said flange; and a liner disposed within said upper, said liner including:

(a) a main body section forming a complete enclosure for the heel and sides of the foot of a wearer, said main body section also forming a sole section which lies completely underneath the arch and heel areas of a wearer's foot, (b) a toe section attached to said main body section and forming an enclosure for the top of the toes and forefoot of a wearer's foot, and (c) an opening defined by said main body section and said toe section which lies underneath the toes and forefoot of a wearer's foot, wherein said forepart of said upper is cement lasted with said toe section of said liner to said insole board.

2. A shoe according to claim 1, wherein said rearpart of sad upper is lasted to said insole board by stitching.

3. A shoe according to claim 1, wherein said rearpart of said upper is lasted to said insole board by a san crispino construction.

4. A shoe according to claim 1, wherein said liner is formed of a material which is impervious to water, but pervious to perspiration vapor.

5. A shoe according to claim 1, further including a footbed which overlies said opening and at least a portion of said insole board.

6. A shoe according to claim 5, wherein said footbed is formed of a waterproof material.

7. A shoe according to claim 1, wherein said upper and said liner both include corresponding tongue and gusset portions formed in said instep region thereof.

* * * * *